US005948352A

United States Patent [19]

Vender Jagt et al.

[11] Patent Number: 5,948,352

[45] **Date of Patent: *Sep. 7, 1999**

[54] TWO-CHAMBER FURNACE FOR COUNTERGRAVITY CASTING

[75] Inventors: A. Dean Vender Jagt, Essexville; Gordon Alwin Tooley, Midland, both of Mich.

[73] Assignees: General Motors Corporation, Detroit; Deltamation Corporation, Bay City, both of Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/961,835

[22] Filed: Oct. 31, 1997

Related U.S. Application Data

[60] Provisional application No. 60/033,167, Dec. 5, 1996.

[51] Int. Cl.[6] ..... C21C 5/42

[52] U.S. Cl. ..... 266/239; 222/595

[58] Field of Search ..... 266/239, 200, 266/236; 222/595, 593, 602

[56] References Cited

U.S. PATENT DOCUMENTS

| | | | |
|---|---|---|---|
| 4,668,554 | 5/1987 | Thornton | 428/36 |
| 4,881,670 | 11/1989 | Yamaoka et al. | 222/590 |
| 5,579,821 | 12/1996 | Vander Jagt | 164/76.1 |
| 5,590,681 | 1/1997 | Schaefer et al. | 137/375 |
| 5,662,859 | 9/1997 | Noda | 266/239 |
| 5,700,422 | 12/1997 | Usui et al. | 266/239 |

FOREIGN PATENT DOCUMENTS

| | | |
|---|---|---|
| 1233410 | 10/1960 | France . |
| 3512868 | 10/1986 | Germany . |
| 2103132 | 2/1983 | United Kingdom . |
| 9513157 | 5/1995 | WIPO . |

OTHER PUBLICATIONS

European Search Report for EP Appln 97 20 3508 dated Mar. 9, 1998 corres to USSN 08/961,835.

*Primary Examiner*—Scott Kastler
*Attorney, Agent, or Firm*—Lawrence B. Plant

[57] ABSTRACT

A two-chamber furnace for the low pressure countergravity casting of metal wherein the first chamber is a molten metal supply chamber connected by a submerged orifice closable by a stopper rod valve to a sealed second chamber that is pressurizable to fill a superjacent mold. The stopper rod valve is readily replaceable from the top of the furnace without having to empty the melt from the furnace.

5 Claims, 4 Drawing Sheets

TWO-CHAMBER FURNACE FOR COUNTERGRAVITY CASTING

This application claims the benefit of U.S. Provisional Application No. 60/033,167 filed Dec. 5, 1996.

TECHNICAL FIELD

This invention relates to a furnace for the low pressure, countergravity casting of metals.

BACKGROUND OF THE INVENTION

Sealed furnaces for the countergravity casting of metal are known, but typically have a limited molten metal capacity based on practical size. As a result, the casting process must be interrupted to recharge such furnaces with metal. Interrupting the casting process results in lost production and oft times results in scrap castings as a result of temperature losses in the equipment and the melt. Moreover, the introduction of large volumes of new metal into such furnaces often results in the introduction of contaminants into the metal which adversely affects the casting process and the castings made therefrom. Decontamination of the melt during recharging adds both cost and time to the process. Finally, considerable energy is lost in the frequent open transfer of molten metal into the furnace which not only wastes such energy but adds to the cost of the process.

SUMMARY OF THE INVENTION

The present invention contemplates an energy and production efficient two-chamber furnace for the low pressure countergravity casting of clean metal into a superjacent mold sealed atop the furnace. The first chamber stores molten metal for quiescent supply to the second chamber. The second chamber is then sealed and pressurized to dispense the metal into the overhead mold. More specifically, the present invention contemplates a furnace for holding molten metal (e.g., aluminum) and dispensing the metal into an overhead mold, wherein the furnace comprises: (1) a first chamber for holding and supplying a quantity of the metal at a desired temperature, preferably under substantially ambient pressure conditions; (2) a gas pressurizable second chamber adjacent the first chamber for receiving metal from the first chamber and dispensing the metal to the mold under superambient pressure conditions; and (3) a partition interjacent the first and second chambers for isolating the chambers one from the other. An opening in the partition communicates the first and second chambers, and is located near the bottoms of the chambers for quiescently admitting clean metal into the second chamber beneath the level of molten metal in the second chamber. At least one immersion heater is provided adjacent the opening in both the first and second chambers to insure that the metal at the opening between the chambers does not freeze. Additional heaters may be used as required to control the temperature of the melt. A stopper-rod valve mates with the opening to permit metal to flow from the first chamber into the second chamber when the valve is open and to prevent such flow when the valve is closed. A gas inlet to the second chamber is provided for admitting sufficient pressurized gas into the second chamber to displace molten metal therefrom into an overhead mold via a riser tube outlet from the second chamber.

In accordance with a preferred embodiment of the invention, the partition comprises a first refractory material permeable by the pressurizing gas in the second chamber, and a barrier layer of a second refractory material which is impermeable by the gas so as to prevent the gas from bleeding into the first chamber when the second chamber is pressurized. Most preferably, the barrier layer is sandwiched between opposing first and second portions of the partition. A preferred barrier material comprises mica pressed into thin sheets.

In accordance with a most preferred embodiment, the stopper-rod valve will be readily removable and replaceable from the top of the furnace without having to empty the metal from the chambers. To this end, the stopper-rod valve comprises: (1) a stopper moveable between an open position for allowing metal to flow through the inter-chamber opening in the partition and a closed position to prevent metal from flowing through the opening; and (2) a sheath surrounding the stopper. The sheath has a valve seat formed on one end thereof adjacent the opening in the partition. The seat defines an orifice which is in registry with the opening in the partition, and is adapted to receive the stopper when the valve is in its closed position. At least one aperture is provided through a wall of the sheath to admit metal into the sheath for flow through the orifice into the second chamber when the stopper is in its open position.

DESCRIPTION OF THE PREFERRED EMBODIMENT

Figure 1:
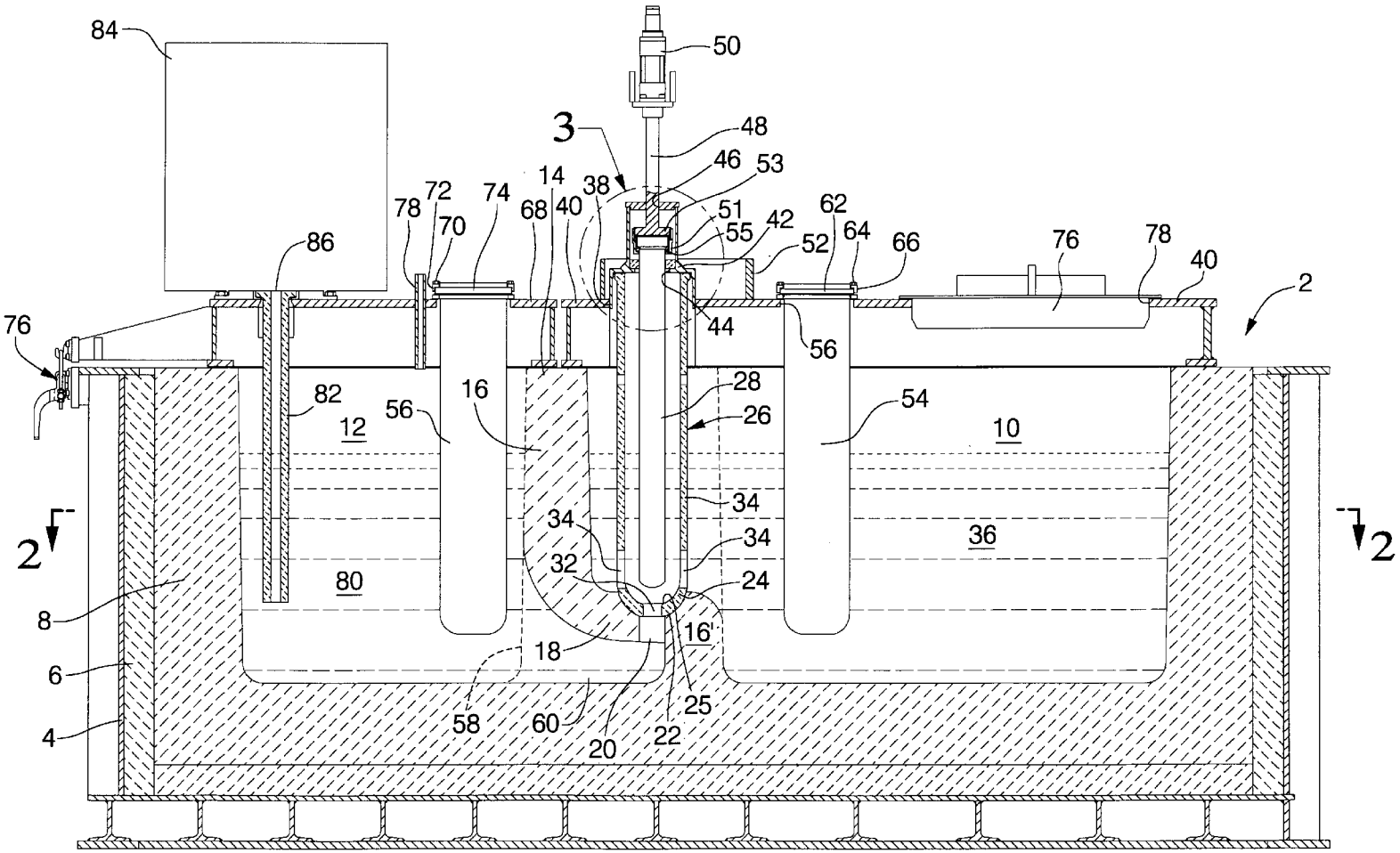
FIG. 1 is a side, partially sectioned view through the furnace.

The Figures show a furnace 2 comprising a metal shell 4 having a first lining 6 of a low density insulating material such as commercially available HPV 45 sold by the North American Refractory Corp., or the like. A second lining 8 comprises a high density second refractory material such as commercially available HPCast 96 AL sold by the North American Refractory Corp., or the like, which is resistant to the attack of the molten metal (e.g., aluminum), and which is cast in place, as is well known in the art. The second lining 8 defines a first metal holding and supply chamber 10 and a second, pressurizable metal dispensing chamber 12 separated one from the other by an inter-chamber partition 14. The partition 14 includes vertical portions 16 and 16', and a substantially horizontal, or shelf, portion 18 near the bottom of the chambers 10 and 12. An opening 20 is provided in the shelf portion 18 of the partition 14 for providing flow communication between chambers 10 and 12. The opening 20 has a mouth 22 which is hemispherically shaped to receive a complimentarily hemispherically shaped nose 24 on the end of a readily replaceable stopper rod valve assembly 26 for controlling the flow of metal between the chambers as will be described in more detail hereinafter. The opening 20 is located adjacent the bottom of the chambers 10 and 12 so as to be located below the level of the melt therein such that when metal flows from the chamber 10 into the chamber 12 it will always exit the chamber 10 and enter the chamber 12 beneath the levels of the melt therein thereby providing quiescent inter-chamber flow of clean metal which does not react with any of the gas in chamber 12.

Figure 3:
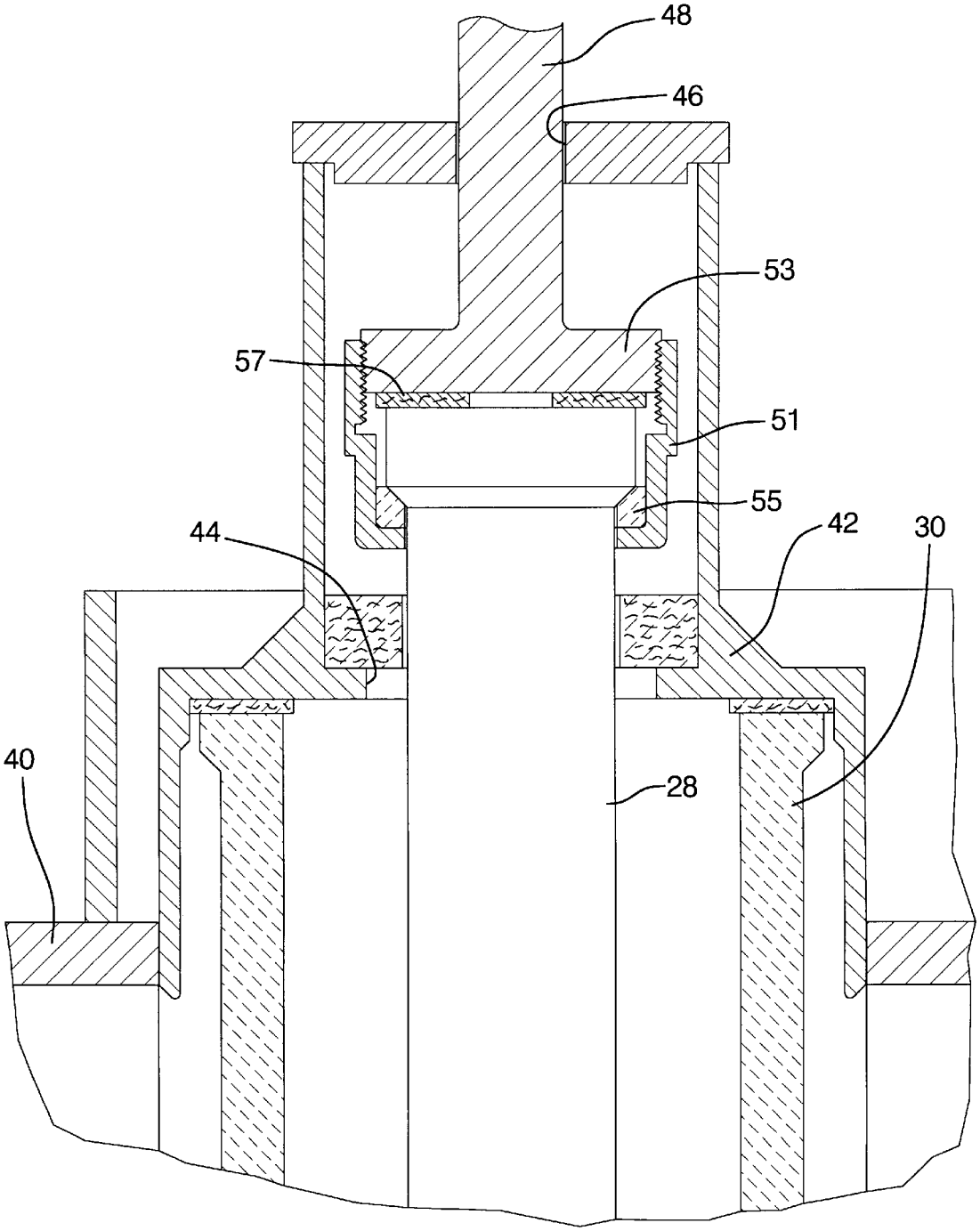
FIG. 3 is a magnified view of the region 3 shown in FIG. 1.

The readily replaceable stopper rod valve assembly 26 includes a melt-resistant (e.g., silicon carbide) stopper member 28 surrounded by a melt-resistant (e.g., silicon carbide) sheath 30. The sheath 30 has a hemispherical nose 24 at one end thereof which includes a valve seat 25 for the stopper 28. The valve seat 25 defmes an orifice 32 which is registered with the opening 20 in the horizontal shelf portion 18 of the partition 14. The sheath 30 also contains at least one aperture 34 for providing access of the metal 36 in the chamber 10 to the orifice 32. The stopper rod assembly 26 is positioned in an opening 38 in a cover 40 that overlies the first chamber 10, and is held in the opening 38 by the weight of a heavy steel cap 42 such that the hemispherical nose 24 of the sheath 30 nests within the hemispherical mouth 22 of the opening 20. The cap 42 includes a first opening 44 (see FIG. 3) through which the stopper 28 can move up and down, and a second opening 46 through which a cylinder rod extension 48 can move up and down. An air cylinder 50 is mounted to a frame (not shown) which in turn is mounted to the cover 40 via annular flange 52 which also serves to stiffen the cover 40 in the region of the stopper valve assembly 26. Actuation of the air cylinder 50 in one direction closes the valve assembly 26 by causing the stopper 28 to engage the seat 25 and plug the orifice 32, and in the other direction to disengage the stopper 28 from the seat 25 and allow metal to flow between the chambers 10 and 12 via the aperture 34, orifice 32 and opening 20. The top of the stopper rod 28 is attached to the cylinder rod extension 48 by means of a steel retainer 51 which screws onto the lower end 53 of the extension rod 48. A machined mica board collar 55 and a compressed ceramic fiber spacer 57 hold the upper end of the rod 28 securely in the retainer 51.

The furnace is preferably heated by gas-fired, or electrically energized immersion heaters which locate the maximum heat within the furnace near the opening communicating the two chambers thus enabling chance cooler metal in the first supply chamber to be brought up to, or near, the casting temperature before entering the sealed pressurizable second chamber from which castings are made. One or more such immersion heaters 54, 54' and 54" extend(s) through openings 56 in the cover 40 in close proximity to the opening 20 in the partition 14 between the chambers 10 and 12 to insure that metal flowing from the chamber 10 into the chamber 12 is hot enough. Similarly, one or more immersion heaters 56 and 56' is/are positioned proximate the opening 20 near the outlet 58 of the throat 60 through which the metal flows from the opening 20 into the chamber 12. The immersion heaters 56, 56' insure(s) that the temperature of the melt in the chamber 12 is at the proper casting temperature. The immersion heater(s) 54, 54' has/have a flange 62 on the upper end(s) thereof which is clamped to the cover 40 by means of bolts 64 and clamping ring 66. Similarly, the immersion heater(s) 56, 56' is/are clamped to the cover 68 of the second chamber 12 by means of bolts 70 which hold the clamping ring 72 in place on the flange 74.

Figure 2:
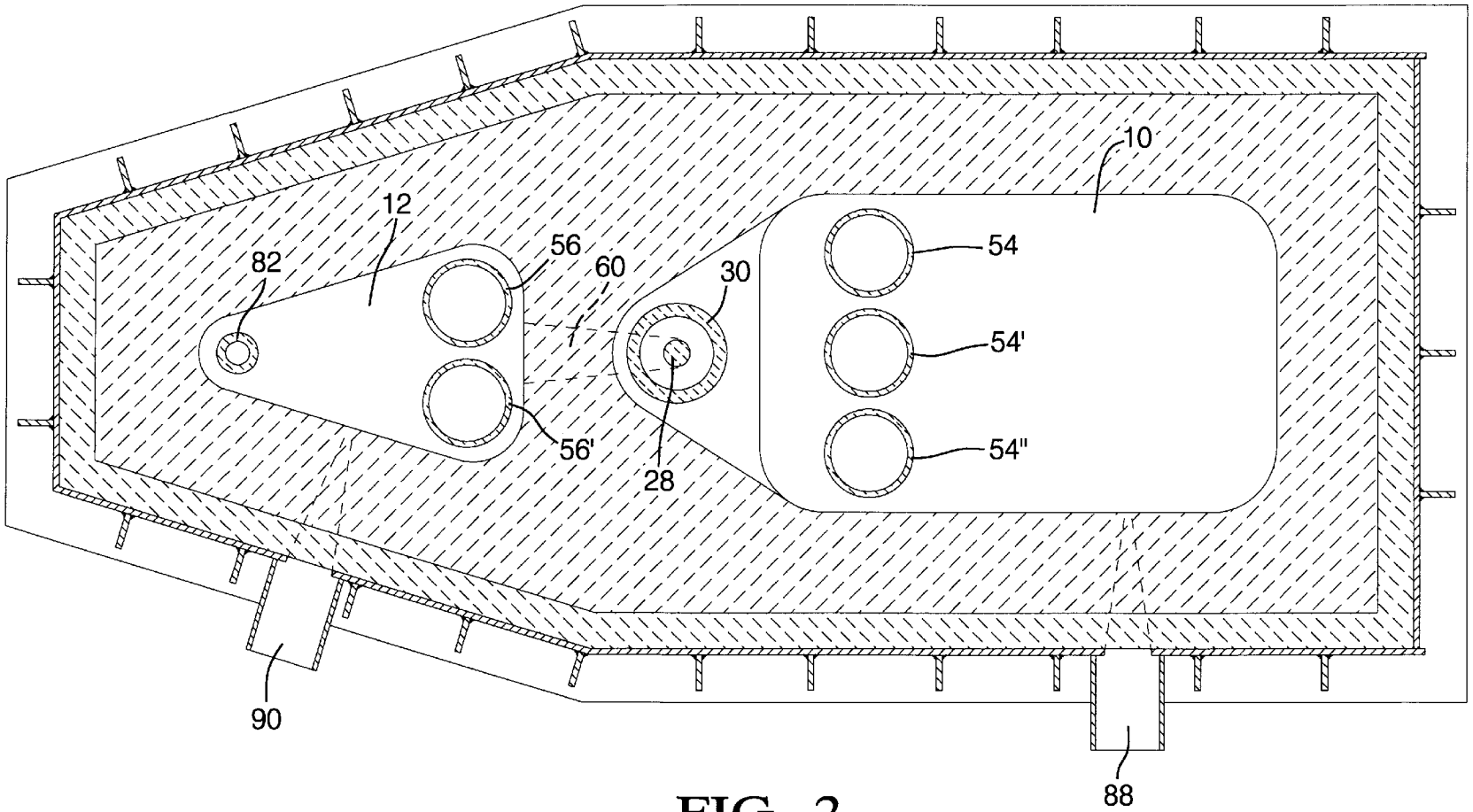
FIG. 2 is a sectioned, plan view of the furnace of FIG. 1 taken in the direction 2—2 of FIG. 1.

A lid 76 fits into an opening 78 in the cover 40 for admitting metal into the chamber 10. Metal so admitted may either be molten or a solid which is subsequently melted in the chamber 10. The cover 68 is sealed atop the dispensing chamber 12 by any convenient means such as the toggle clamps 76. A gas inlet 78 is provided through the cover 68 for admitting a pressurizing gas (e.g., air, $N_2$, etc.) into the dispensing chamber 12 to displace the metal 80 therein and force it up through a ceramic (e.g., Si C) riser tube 82 and into the mold 84 which is sealed atop the outlet end 86 of the riser tube 82 as is well known in the low pressure countergravity casting art. As best shown in FIG. 2, first chamber 10 is provided with a drain 88 for emptying the chamber 10, and chamber 12 is provided with a drain 90 for draining the chamber 12 as may be needed from time to time.

Figure 4:
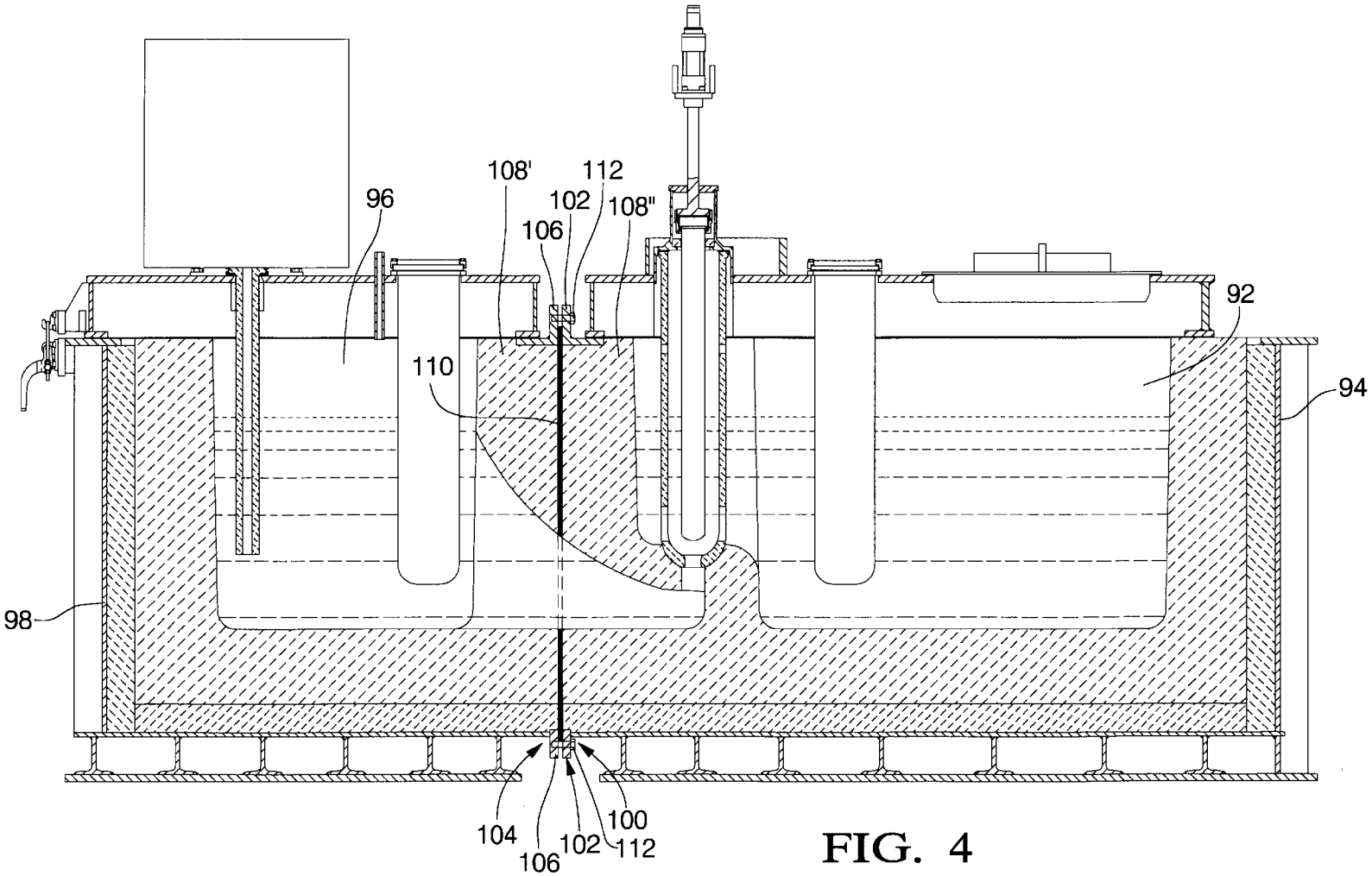
FIG. 4 is a partially sectioned side view like that of FIG. 1 of a preferred embodiment of the present invention.

FIG. 4 depicts a preferred embodiment of the present invention which, in most respects, is identical to the furnace described in conjunction with FIGS. 1 and 2. Accordingly, much of the details of the FIG. 3 embodiment will not be repeated hereafter. However, the embodiment shown in FIG. 4 differs from that in FIG. 1 in one primary respect. In this regard, it was noted in the operation of the embodiment of FIG. 1 that some of the pressurizing gas introduced into chamber 12 would bleed across the partition 14 into the chamber 10. This not only reduced the pressure in chamber 12, but unnecessarily pressurized the chamber 10. Interchamber gas bleeding seemingly occurred for two reasons. First, the refractory forming the partition 14 was inherently porous to some degree which allowed some gas to pass. More significantly however, the refractory forming the partition 14 formed microcracks therein with use, as is common with such refractories, and the microcracks so formed allow the pressurizing gas to pass into chamber 10 from chamber 12. To avert this in accordance with the embodiment shown in FIG. 3, the supply chamber 92 and dispensing chamber 96 are contained within their own half-shells 94 and 98, respectively. One end 100 of the half-shell 94 does not have an end wall, but rather includes a peripheral flange 102 on the perimeter thereof. Similarly, one end 104 of the half-shell 98 does not have an end wall, but rather a peripheral flange 106. The partition 108 is formed by two opposing partition portions 108' and 108" each in a different one of the half-shells 94 and 98. A a gas impermeable barrier 110 is sandwiched between the partition portions 108' and 108" and held in place by bolting 112 the flanges 102 and 106 together as shown. A suitable such impermeable barrier comprises pressed mica board sold by Cogebi, Inc. under the tradename Cogetherm HP, or the like.

In operation, a mold 84 having a mold cavity (not shown) therein and a gate or runner opening (not shown) on the underside thereof is positioned atop the riser tube 82 such that the opening in the bottom of the mold is aligned with, and sealed to, the outlet 86 of the riser tube 82. With the opening 20 between the two furnaces closed by the stopper rod valve 26, a gas (e.g., inert or air) is introduced into the sealable second chamber 12 so as to displace molten metal 80 therefrom by forcing it up the riser tube 82 and into the mold 84. The pressure is held during solidification of the casting, and is released before solidification occurs in the riser tube 82. The mold 84 is then removed. During the time the mold 84 is being removed and replaced with another mold, the stopper rod valve 26 opens so as to allow metal to flow from the first chamber 10 into the second chamber 12 where it seeks the level of the metal in the first chamber 10. The metal exits the first chamber 10 beneath the level of the metal therein and enters the second chamber 12 beneath the level of the melt therein which results in quiescent flow of clean metal into the second chamber 12 in a manner which also prevents reaction of the metal with the gas in the second chamber (e.g., air). The stopper rod valve 26 then closes and the process repeats. As a result, clean, hot metal is quickly and repeatedly transferred to the dispensing chamber 12 without any significant interruption of the casting process. The first chamber may be resupplied at any time during the casting operation by adding molten metal thereto by means of a ladle, pump, siphon, launder or the like. Ingots and scrap may also be added and melted in the first chamber if so desired. Decontamination devices may be installed at the charging inlet to the first chamber, remote from the opening between the two chambers, to decontaminate the metal before it reaches the sealable pressure chamber. Appropriate level detectors and/or temperature sensors may be installed in one or both chambers as desired for monitoring the furnace.

While the invention has been disclosed primarily in terms of a specific embodiment thereof it is not intended to be limited thereto but rather only to the extent set forth hereafter in the claims which follow.

We claim:

1. A furnace for holding molten metal and dispensing said metal to a mold, said furnace comprising a first chamber for holding a quantity of said metal; a gas pressurizable second chamber adjacent said first chamber for dispensing said metal to said mold under super ambient pressure conditions; a partition interjacent said first and second chambers for isolating said chambers one from the other; an opening in said partition communicating said first and second chambers, said opening being located near the bottom of said second chamber for admitting said metal into said second chamber beneath the level of molten metal in said second chamber; at least one immersion heater adjacent said opening in said first chamber; at least one immersion heater adjacent said opening in said second chamber; a stopper-rod valve operatively associated with said opening to permit metal to flow from said first chamber into said second chamber via said opening when said valve is open and prevent such flow when said valve is closed; a gas inlet to said second chamber for admitting sufficient pressurized gas into said second chamber to displace molten metal therein externally of said second chamber; and an outlet form said second chamber for discharging molten metal displaced by said gas from said second chamber into said mold.

2. A furnace for holding molten metal and dispensing said metal to a mold, said furnace comprising a first chamber for holding a quantity of said metal; a gas pressurizable second chamber adjacent said first chamber for dispensing said metal to said mold under super ambient pressure conditions; a partition interjacent said first and second chambers for isolating said chambers one from the other; an opening in said partition communicating said first and second chambers, said opening being located near the bottom of said second chamber for admitting said metal into said second chamber beneath the level of molten metal in said second chamber; at least one immersion heater adjacent said opening in said first chamber; at least one immersion heater adjacent said opening in said second chamber; a gas inlet to said second chamber for admitting sufficient pressurized gas into said second chamber to displace molten metal therein externally of said second chamber; an outlet form said second chamber for discharging molten metal displaced by said gas from said second chamber into said mold; and a readily replaceable stopper-rod valve assembly comprising:

(a) a stopper moveable between an open position for allowing metal to flow through said opening and a closed position to prevent metal from flowing through said opening, and (b) a sheath surrounding said stopper, said sheath having (1) a valve seat mateable with said stopper on one end of said sheath adjacent said opening and defining an orifice in registry with said opening, and (2) at least one aperture through a wall of said sheath for admitting metal into said sheath from the first chamber and thence through said orifice into said second chamber when said stopper is in said open position.

3. A furnace for holding molten metal and dispensing said metal to a mold, said furnace comprising a first chamber for holding a quantity of said metal; a gas pressurizable second chamber adjacent said first chamber, said second chamber being adapted to receive a pressurizing gas for dispensing said metal to said mold under super ambient pressure conditions; a partition interjacent said first and second chambers for isolating said chambers one from the other, said partition comprising a first refractory material permeable by said pressurizing gas and a barrier layer of a second refractory material which is impermeable by said gas to prevent said gas from bleeding into said first chamber when said second chamber is pressurized; an opening in said partition communicating said first and second chambers, said opening being located near the bottom of said second chamber for admitting said metal into said second chamber beneath the level of molten metal in said second chamber; at least one immersion heater adjacent said opening in said first chamber; at least one immersion heater adjacent said opening in said second chamber; a stopper-rod valve operatively associated with said opening to permit metal to flow from said first chamber into said second chamber via said opening when said valve is open and prevent such flow when said valve is closed; a gas inlet to said second chamber for admitting gas into said second chamber to displace molten metal therein externally of said second chamber; and an outlet form said second chamber for discharging molten metal displaced by said gas from said second chamber into said mold.

4. A furnace according to claim 3 wherein said barrier layer is sandwiched between opposing first and second portions of said partition.

5. A furnace according to claim 3 wherein said barrier comprises mica.

* * * * *

UNITED STATES PATENT AND TRADEMARK OFFICE

CERTIFICATE OF CORRECTION

PATENT NO : 5,948,352

DATED : September 7, 1999

INVENTOR(S) : A. Dean Vander Jagt; Gordon Alwin Tooley

It is certified that error appears in the above-identified patent and that said Letters Patent is hereby corrected as shown below:

Title page: Item [19]
Please correct as follows:

"Vender Jagt et al." should read as --Vander Jagt et al.--

(75) Inventors: "A. Dean Vender Jagt" should read as
—A. Dean Vander Jagt--

Signed and Sealed this

Twenty-second Day of February, 2000

*Attest:*

Q. TODD DICKINSON

*Attesting Officer*

*Commissioner of Patents and Trademarks*